US005970546A

United States Patent [19]

Danis

[11] Patent Number: 5,970,546

[45] Date of Patent: Oct. 26, 1999

[54] PORTABLE HEADREST HAVING A BASE SUPPORT MEMBER WITH AIR PASSAGES FOR USE WHILE SUNBATHING

[75] Inventor: Gina Danis, Trevose, Pa.

[73] Assignee: Paul Shalita, Trenton, N.J.

[21] Appl. No.: 09/031,163

[22] Filed: Feb. 26, 1998

[51] Int. Cl.[6] ..... A47C 20/02

[52] U.S. Cl. ..... 5/636; 5/638; 5/643

[58] Field of Search ..... 5/636, 638, 622, 5/725, 639, 640, 642, 643, 637

[56] References Cited

U.S. PATENT DOCUMENTS

| | | | |
|---|---|---|---|
| D. 229,266 | 11/1973 | Zacharias | 5/636 |
| 2,239,003 | 4/1941 | Jones | 5/638 |
| 2,551,727 | 5/1951 | Costello | 5/638 |
| 2,561,931 | 6/1951 | Kleiser | 5/636 |
| 5,546,619 | 8/1996 | Braun | 5/638 |

*Primary Examiner*—Michael F. Trettel
*Assistant Examiner*—Fredrick Conley
*Attorney, Agent, or Firm*—Ezra Sutton

[57] ABSTRACT

A portable headrest for sunbathing including a head support member having a generally U-shaped configuration. The head support member includes an outer material covering, an internal foam support cushion and a rigid support plate on the bottom thereof; a rigid base support member having a generally curved-shaped configuration for providing a stable support on sand, soft ground, or grass; a plurality of spaced-apart support connecting members for connecting the head support member to the base support member; and the plurality of spaced-apart support connecting members defining a plurality of air passageways between the bottom of the head support member and the top of the base support member for allowing the passage of air therethrough to the user's face when the face is embedded in the head support member.

20 Claims, 5 Drawing Sheets

PORTABLE HEADREST HAVING A BASE SUPPORT MEMBER WITH AIR PASSAGES FOR USE WHILE SUNBATHING

FIELD OF INVENTION

This invention relates to a portable U-shaped or curved headrest having a base support member with air passages for use while sunbathing. More particularly, the U-shaped headrest includes a U-shaped head support member and rigid U-shaped base support member having a plurality of connecting members therebetween for defining a plurality of air passageways through which the sunbather obtains air when the user is sunbathing in a facedown position.

BACKGROUND OF INVENTION

The use of various U-shaped or horseshoe-shaped headrests, pads, pillows, cushions, bolsters, head supporting devices for sunbathing, massage therapy, chiropractic adjustment, medical examinations and operations are well known in the prior art. The prior art includes U-shaped headrests having a plurality of legs attached to the headrest to provide a level of elevation to the headrest for comfort and breathing when in a facedown position. In using these prior art devices in sand, soft ground or grass the legs and headrest sink into the sand, soft ground or grass and interfere with the user's breathing or receiving an ample amount of air in order to be comfortable when in a facedown position in the headrest.

There remains a need for a portable headrest for outdoor suntanning or sunbathing having a head support member, a plurality of support connecting members, a rigid base support member for sand, ground or grass contact, and a carrying strap. Additionally, the head support member and the rigid base support member should have support connecting members therebetween for defining a plurality of air passageways through which the user obtains an air supply when the user's face is in a downward position in the head support member while suntanning. Further, the base support member should be of sufficient size and area for preventing the sinking of the base support member and the head support member into sand, soft ground, or grass.

DESCRIPTION OF THE PRIOR ART

U-shaped or horseshoe-shaped headrests, pillows, head supports and cushions of various designs, structures, and materials of construction have been disclosed in the prior art. For example, U.S. Pat. No. 5,546,619 to BRAUN discloses a head supporting device for use while suntanning or sunbathing. The head support device includes a rigid horseshoe-shaped head support member having a plurality of pivotal supporting legs attached to the bottom wall of the head support member. This prior art patent does not disclose the particular structure and design of the present invention having a portable U-shaped headrest with a U-shaped base support member which defines air passages for use while sunbathing.

U.S. Pat. No. 3,926,181 to EISCHEN discloses a cervical-dorsal relaxation pad for supporting the head and shoulders of a user while the user is laying face down. The relaxation pad includes a substantially U-shaped pad having a base plate with a plurality of support legs attached to the base plate. The relaxation pad is used in conjunction with a horizontal top surface of a massage table. This prior art patent does not disclose the particular structure and design of the present invention having a portable U-shaped headrest with a U-shaped base support member which defines air passages for use while sunbathing.

U.S. Pat. No. 5,177,823 to RIACH discloses an adjustable U-shaped headrest for use in conjunction with chiropractic and medical examination tables and exercise tables. This prior art patent does not disclose the particular structure and design of the present invention having a portable U-shaped headrest with a U-shaped base support member which defines air passages for use while sunbathing.

U.S. Pat. No. 5,214,815 to AGBODOE et al discloses a U-shaped surgical headrest with a removable foam pad. The surgical headrest is used in conjunction with the operating room table. This prior art patent does not disclose the particular structure and design of the present invention having a portable U-shaped headrest with a U-shaped base support member which defines air passages for use while sunbathing.

U.S. Pat. Nos. 4,738,488 and 5,257,429 disclose U-shaped pillows, U-shaped bolsters or U-shaped cushions for support of the head and neck areas. These prior art patents do not disclose the particular structure and design of the present invention having a portable U-shaped headrest with a U-shaped base support member which defines air passages for use while sunbathing.

None of the prior art patents disclose a U-shaped base support member which prevents the U-shaped headrest of the present invention from sinking into sand or soft ground, as well as having air passages for supplying air to the user between the U-shaped head support member and the U-shaped base support member when the user is facing downward on the U-shaped headrest device. In addition, the U-shaped base support member provides further support and stability to the user when in operational use.

Accordingly, it is an object of the present invention to provide a portable headrest that is U-shaped in configuration having a U-shaped head support member, a plurality of support connecting members, a rigid U-shaped base support member for contacting a soft surface, such as sand, grass or the ground, and a carrying strap.

Another object of the present invention to provide a headrest wherein the U-shaped head support member and rigid U-shaped base support member have a plurality of connecting members therebetween to define a plurality of air passageways through which the sunbather obtains an air supply when the user's face is in a downward position in the head support member in order to obtain a sufficient amount of air while the user is in a face down position.

Another object of the present invention is to provide a headrest wherein the base support member has a sufficiently large surface area for preventing the sinking of the base support member and the head support member into sand, soft ground or grass when the user is laying facedown on the head support member.

Another object of the present invention is to provide a headrest wherein the base support member additionally provides further support and stability to the headrest when in operational use for preventing any lateral movement of the headrest in sand, soft ground, or grass.

Another object of the present invention is to provide a headrest wherein the outer material covering the head support member is durable in use and is easily washed, rinsed and sanitized for repeated use by the user.

Another object of the present invention is to provide a headrest that is portable, compact, light-weight for easy transport, convenient to carry by a carrying strap and allows compact storage by the user.

Another object of the present invention is to provide a headrest wherein the head support member may be non-inflatable having an internal foam support pad therein, or alternatively, may be inflatable by air with the use of an inflation device.

Another object of the present invention is to provide a headrest device having multi-functional uses, such as for indoor or outdoor suntanning, massage therapy or chiropractic adjustments.

A further object of the present invention is to provide a portable U-shaped headrest that can be mass produced in an automated and economical manner and is readily affordable by the user.

SUMMARY OF THE INVENTION

In accordance with the present invention, there is provided a portable headrest which includes a head support member having a generally U-shaped or curved configuration; the head support member having an outer material covering, an internal foam support cushion and a rigid support plate on the bottom thereof; a rigid base support member having a generally U-shaped or curved configuration for providing a stable support on sand, soft ground, or grass; a plurality of spaced-apart support connecting members for connecting the head support member to the base support member; and the plurality of spaced-apart support connecting members defining a plurality of air passageways between the bottom of the head support member and the top of the base support member for allowing the passage of air therethrough to the user when the user's face is embedded downwardly in the head support member.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED EMBODIMENT

Figure 1:
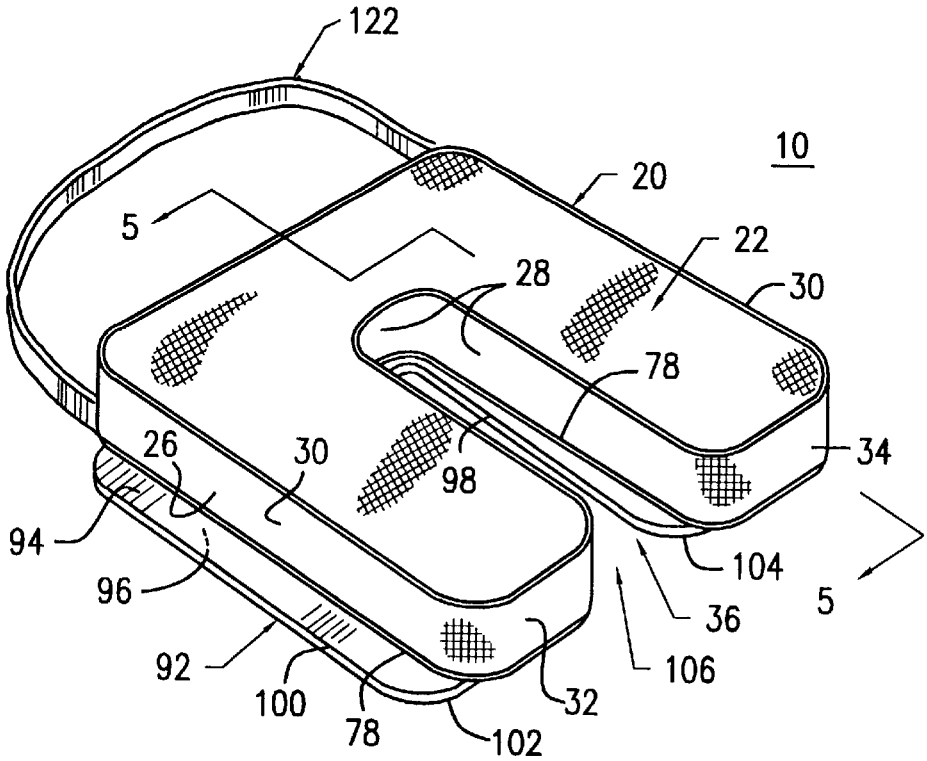
FIG. 1 is a front perspective view of the headrest of the preferred embodiment of the present invention showing the U-shaped head support member having an outer material covering, the rigid U-shaped base support member, and the carrying strap.
Figure 2:
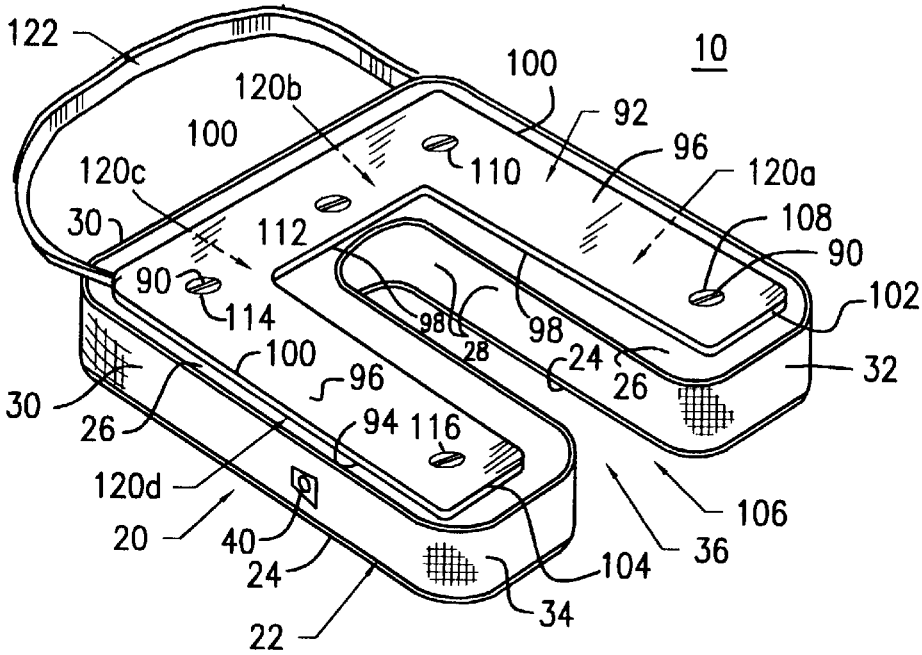
FIG. 2 is a rear perspective view of the headrest of the present invention showing the rigid U-shaped base support member, the U-shaped head support member having an outer material covering, and the carrying strap.
Figure 3:
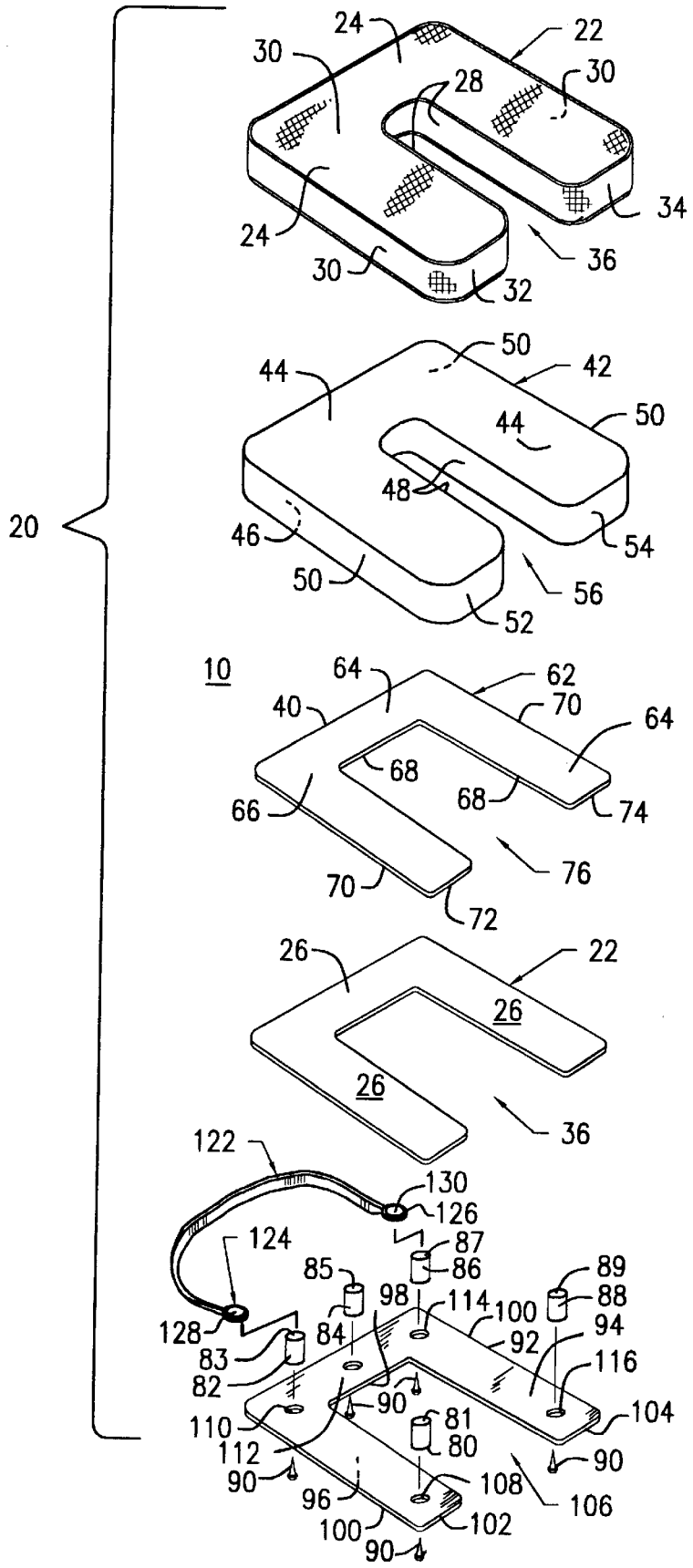
FIG. 3 is an exploded perspective view of the headrest of the present invention showing the major component parts contained therein.
Figure 4:
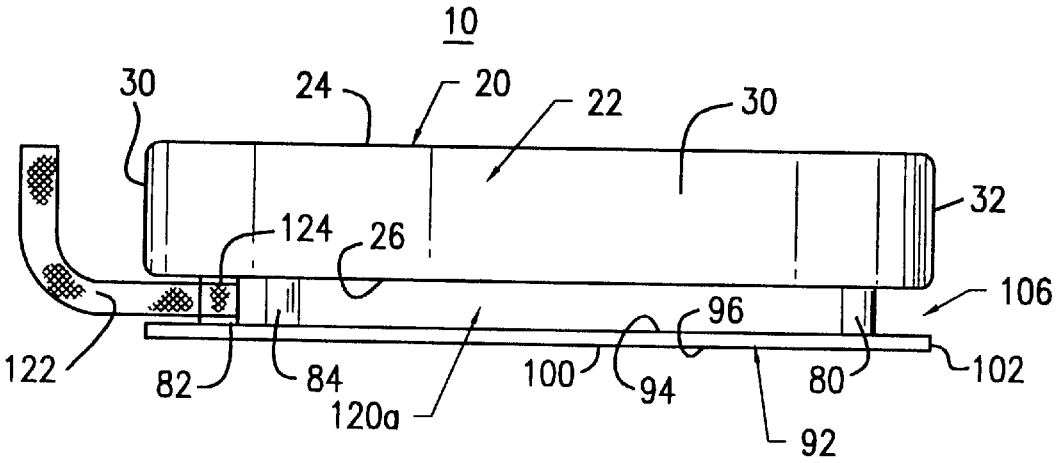
FIG. 4 is a side elevational view of the headrest of the present invention showing the U-shaped head support member and U-shaped base support member having a plurality of connecting members therebetween for defining an air passageway.
Figure 5:
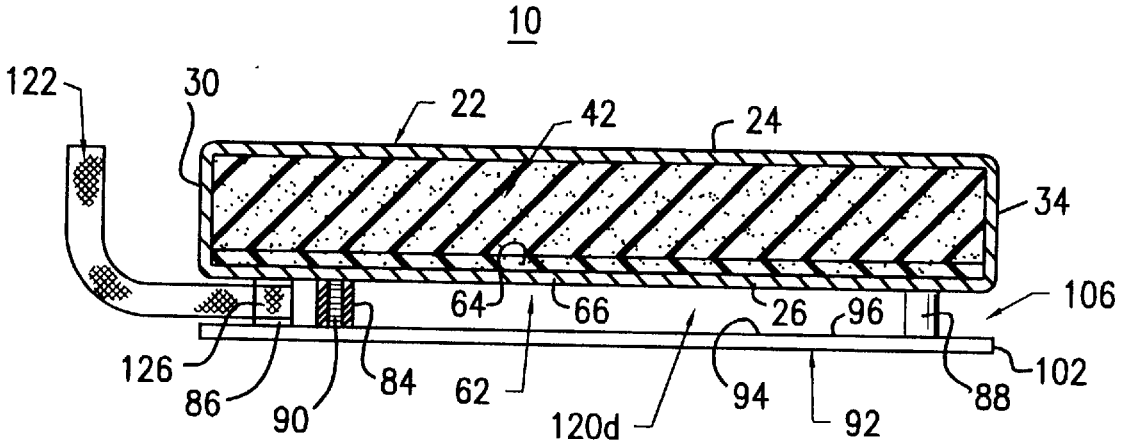
FIG. 5 is a cross-sectional view of the headrest of the present invention taken along lines 5—5 of FIG. 1 showing the U-shaped head support member having an outer material covering, an inner foam support cushion, and a rigid foam support plate a rigid U-shaped base support member; a plurality support connecting members; and a carrying strap.
Figure 6:
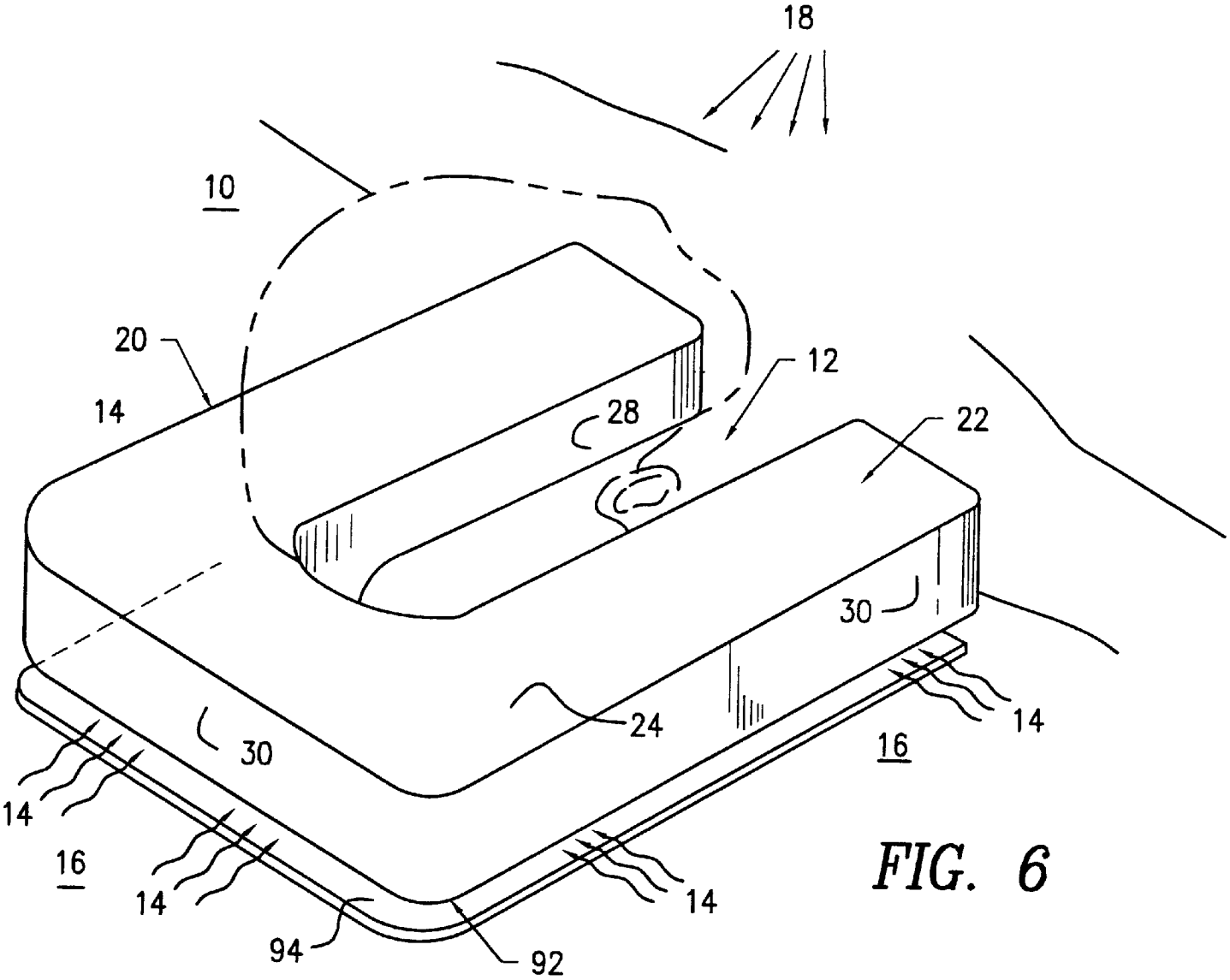
FIG. 6 is a front perspective view of the headrest of the present invention showing the headrest in operational use.

The portable U-shaped headrest 10 having a rigid U-shaped base support member 92 and air passageways 120*a* to 120*d* for use while sunbathing or suntanning are represented in detail in FIGS. 1 through 6 of the drawings. The headrest 10, as shown in FIG. 3, includes an U-shaped head support member 20 having an outer U-shaped material covering 22, an internal U-shaped foam support cushion 42, and an internal and rigid U-shaped foam support plate 62; a plurality of support connecting members 80, 82, 84, 86 and 88; a rigid U-shaped base support member 92; and a carrying strap 122. The U-shaped head support member 20 and the U-shaped base support member 92 have a plurality of support connecting members 80, 82, 84, 86 and 88 therebetween and define a plurality of air passageways 120*a* to 120*d* through which the user obtains his/her air supply 14 when the user's face 12 is in a downward position in the head support member 20 of the headrest 10, as shown in FIG. 6 of the drawings.

The outer U-shaped material covering 22 of the U-shaped head support member 20, as shown in FIG. 3 of the drawings, includes a top wall 24, a bottom wall 26, an inner perimeter side wall 28, an outer perimeter side wall 30, a first end 32 and a second end 34 having an opening space 36 therebetween. The outer material covering 22 can be made of covering materials selected from the group consisting of vinyls, leathers, cottons, cotton-blends, nylons, rayons, polyesters, neoprenes, and combinations thereof.

The internal U-shaped foam support cushion 42 includes a top wall surface 44, a bottom wall surface 46, an inner perimeter side wall surface 48, an outer perimeter side wall surface 50, a first end 52 and a second end 54 having an opening space 56 therebetween. The U-shaped foam support cushion 42 conforms within the U-shaped material covering 22, as shown in FIGS. 5 and 6 of the drawings, so as to give the user's face 12 a soft cushion to rest on when his/her face 12 is in a downward position in the head support member 20.

The top wall 24, inner and outer perimeter side walls 28 and 30; and first and second ends 32 and 34 of the covering material 22 are adjacent and in contact with the top wall surface 44, inner and outer perimeter side wall surfaces 48 and 50; and first and second ends 52 and 54 of the internal foam support cushion 42, as shown in FIGS. 3 and 5 of the drawings. The foam support cushion 42 can be made from foam materials such as urethanes, aerated rubber, cotton pads and the like.

The rigid U-shaped foam-support plate 62 includes, as shown in FIGS. 3 and 4 of the drawings, a top wall surface 64, a bottom wall surface 66, an inner perimeter edge 68, an outer perimeter edge 70, a first end 72 and a second end 74 having an opening space 76 therebetween. The foam-support plate 62 can be made of rigid and durable materials selected from the group consisting of plastics; light weight metals such as aluminum; and wood products such as plywood, luan, or composite chip board. The bottom wall surface 46 of the foam support component 42 is adjacent and in contact with the top wall surface 64 of the foam support plate 62; and the bottom wall surface 66 of the foam support plate 62 is adjacent and in contact with the bottom wall 26 of the outer material covering 22. Additionally, a lower perimeter stitched seam 78 encloses the foam support component 42 and the rigid foam-support plate 62 within the outer material covering 22 of the U-shaped head support member 20.

The head support member 20 may be non-inflatable (as in the preferred embodiment) or alternatively, may be inflatable by the user (does not have the internal U-shaped foam support cushion 42) with the use of an inflation device 40 located on the outer perimeter side wall 30 of the outer material covering 22, as shown in FIG. 2 of the drawings.

The plurality of support connecting members 80, 82, 84, 86 and 88 include central openings 81, 83, 85, 87 and 89, respectively, for receiving of screws 90 therein. The plurality of support connecting members 80, 82, 84, 86 and 88 connect the base support member 92 to the inner foam support plate 62 via screws 90 within openings 81, 83, 85, 87 and 89, respectively. Support connecting members 80, 82, 84, 86 and 88 can be made from rigid and durable tubular materials such as plastic or metal. They define air passageways 120*a* to 120*d* for air to pass into the center open space 36.

The rigid U-shaped base support member 92 includes a top wall surface 94, a bottom wall surface 96, an inner perimeter edge 98, an outer perimeter edge 100, a first end 102 and a second end 104 having an open space 106 therebetween. Base support member 92 further includes a plurality of openings 108, 110, 112, 114 and 116 for receiving of screws 90 therein. Screw openings, 108, 110, 112, 114 and 116 are aligned with support connecting openings 81, 83, 85, 87 and 89, respectively, of support connecting members 80, 82, 84, 86 and 88 for attaching the base support member 92 to the inner foam-support plate 62, as previously mentioned. The base support member 92 can be made of rigid and durable materials selected from the group consisting of plastics, light-weight and plastic coated metals, plasticized-rubber, and wood products. The base support member 92 is of sufficient surface area (at least 62½ square inches) so as to prevent the sinking of the base support member 92 and the head support-member 20 into sand or soft ground when in operational use by the user, as he/she is laying face down on the head support member 20, as shown in FIG. 6 of the drawings.

The carrying strap 122 includes a pair of attachment loops 124 and 126 having openings 128 and 130 therein. Carrying strap 122 is used for carrying of the headrest 10 by the user. Attachment loops 124 and 126 are attached to support connecting members 82 and 86, respectively, via attachment loop openings 128 and 130, as shown in FIG. 3 of the drawings. Carrying strap 122 can be made of fabric materials, leather or flexible plastics.

The U-shaped headrest 10 has physical dimensions as follows: The U-shaped head support member has an overall width measurement of 11½ inches ±½ inch, an overall length measurement of 11½ inches ±½ inch, and an overall thickness measurement of 2¼ inches ±¼ of an inch.

The top and bottom walls 24 and 26 have an overall width measurement of 4⅜ inches ±¼ of an inch. The opening space 36 between the first and second ends 32 and 34 has a width measurement of 2¾ inches ±¼ of an inch.

The support connecting members 80, 82, 84, 86 and 88 each have an overall diameter measurement of ⅜ of an inch ±⅛ of an inch, and an overall height measurement of 1 inch ±⅛ of an inch.

The rigid U-shaped base support member 92 has an overall width measurement of 10 inches ±½ of an inch, an overall length measurement of 10 inches ±½ of an inch and an overall thickness measurement of 3/16 of an inch ±1/16 of an inch. The top and bottom wall surfaces 94 and 96 have an overall width measurement of 2½ inches ±¼ inches. The opening space 106 between the first and second ends 102 and 104 has a width measurement of 5 inches ±¼ of an inch. Base support member 92 has a surface area measurement of at least 60 square inches ±2½ square inches.

The U-shaped headrest 10 has an overall weight measurement of 1¾ pounds ±¼ of a pound depending upon the materials of construction used when headrest 10 is manufactured.

Figure 7:
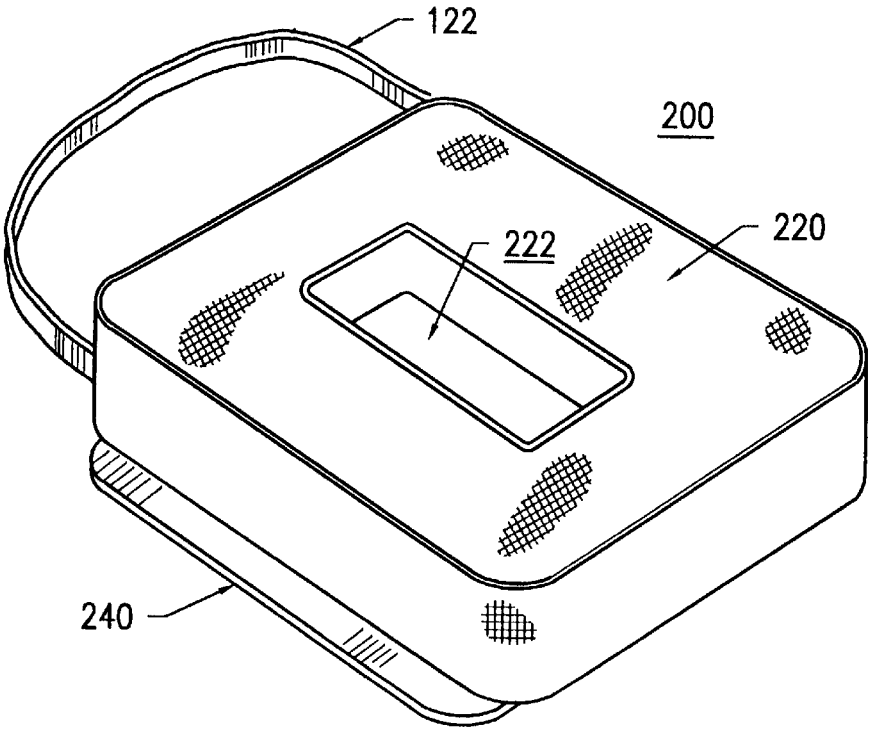
FIG. 7 is a front perspective view of an alternative embodiment of the present invention showing an O-shaped head support member having an outer material covering, a rigid O-shaped base support member, and the carrying strap.
Figure 8:
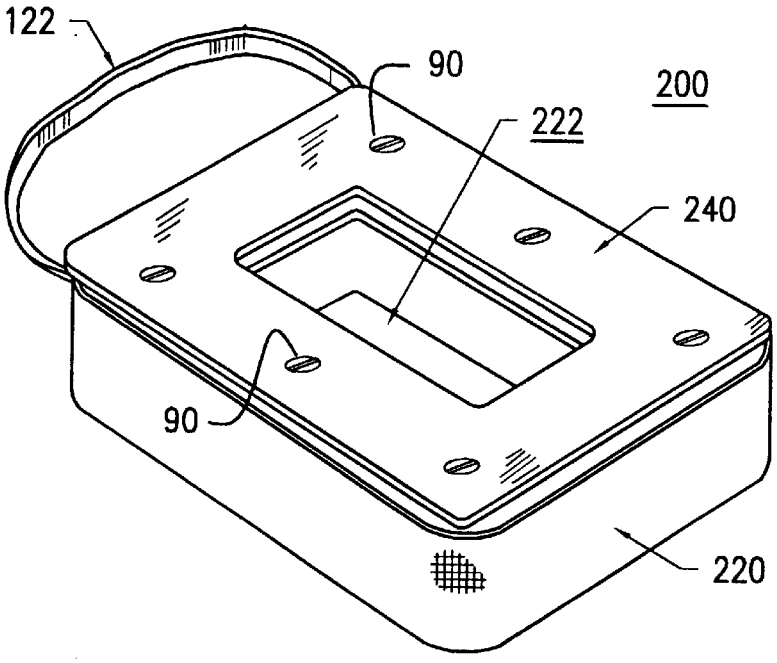
FIG. 8 is a rear perspective view of the headrest of FIG. 7 showing the rigid O-shaped base support member, the O-shaped head support member having an outer material covering, and the carrying strap.

An alternate embodiment 200, as shown in FIGS. 7 and 8 of the drawings, includes a portable headrest 200 having a head support member 220 with a generally curved-shape configuration, a recess 222 for receiving the user's face; and a rigid base support member 240 having a generally curved-shaped configuration for providing a stable support on sand, soft ground or grass. In all other respects the headrest 200 of the alternate embodiment is the same as the headrest 10 of the preferred embodiment.

The portable U-shaped headrest 10 and 200 can be used for outdoor sunbathing or indoor suntanning, as well as for indoor massage therapy or chiropractic adjustment.

OPERATION OF THE PRESENT INVENTION

In operation, as shown in FIG. 6, the user appropriately places the portable U-shaped headrest 10 on the sand, ground or grass in a position such that the user receives the correct angle of sunlight 18 for a proper tanning of his/her skin. The user then places his/her face 12 in a downward position in the open space 36. The user 12 obtains his/her air supply 14 from the defined air passageways 120*a* to 120*d*, in order to obtain a sufficient amount of air 14, even though the user's face 12 is in a downward position in the opening space 36 of the head support member 20 of the headrest 10. The structure and configuration of the base support member 92 is of sufficiently large surface area having at least 62½ square inches which prevents the sinking of the base support member 92 and the head support member 20 into the sand, soft ground, or grass when the sunbather is laying face down on the head support member 20 while sunbathing.

When the user has finished using the headrest 10, he/she simply picks up the headrest 10 by the carrying strap 122, shakes off any sand, dirt, grass or debris from the head support member 20 and/or base support member 92. The outer material covering 22 can be easily hand washed, rinsed in water, and sanitized by the user for repeated re-use, and is easily stored for future usage.

ADVANTAGES OF THE PRESENT INVENTION

Accordingly, an advantage of the present invention is that it provides for a portable headrest that is U-shaped in configuration having a U-shaped head support member, a plurality of support connecting members, a rigid U-shaped base support member for contacting a soft surface, such as sand, grass or the ground, and a carrying strap.

Another advantage of the present invention is that it provides for a headrest wherein the U-shaped head support member and the rigid U-shaped base support member have a plurality of connecting members therebetween to define a plurality of air passageways through which the sunbather obtains an air supply when the user's face is in a downward position in the head support member in order to obtain a sufficient amount of air while the user is in a face down position.

Another advantage of the present invention is that it provides for a headrest where the base support member is of sufficiently large surface area for preventing the sinking of the base support member and the head support member into sand, soft ground or grass when the user is laying facedown on the head support member.

Another advantage of the present invention is that it provides for a headrest wherein the base support member additionally provides further support and stability to the headrest when in operational use for preventing any lateral movement of the headrest in sand, soft ground, or grass.

Another advantage of the present invention is that it provides for a headrest wherein the outer material covering the head support member is durable in use and is easily washed, rinsed and sanitized for repeated use by the user.

Another advantage of the present invention is that it provides for a headrest that is portable, compact, light-weight for easy transport, convenient to carry by a carrying strap and allows compact storage by the user.

Another advantage of the present invention is that it provides for a headrest wherein the head support member may be non-inflatable having an internal foam support pad therein, or alternatively, may be inflatable by air with the use of an inflation device.

Another advantage of the present invention is that it provides for a headrest device having multi-functional uses, such as for indoor or outdoor suntanning, massage therapy or chiropractic adjustments.

A further advantage of the present invention is that it provides for a portable U-shaped headrest that can be mass produced in an automated and economical manner and is readily affordable by the user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A portable headrest for sunbathing, comprising:

a) a head support member having a generally U-shaped configuration;

b) said head support member including an outer material covering, an internal foam support cushion and a rigid support plate on the bottom thereof;

c) a rigid base support member having a flat and generally U-shaped configuration for providing a stable support on sand, soft ground, or grass without sinking therein; said rigid base support member having an outer perimeter edge and an inner perimeter edge with an open space therebetween;

d) a plurality of spaced-apart support connecting members for connecting said head support member to said base support member;

e) said plurality of spaced-apart support connecting members defining a plurality of air passageways between the bottom of said head support member and the top of said base support member for allowing the passage of air therethrough to the user's face when the face is embedded downwardly in said head support member; and f) said headrest having a weight measurement in the range of 1½ sounds to 2 pounds for ease of portability by the user.

2. A headrest in accordance with claim 1, further including a detachable carrying strap for carrying said headrest.

3. A headrest in accordance with claim 1, wherein said head support member includes a top wall, a bottom wall, inner side walls, and outer side walls; said inner side walls having an open space therebetween.

4. A headrest in accordance with claim 3, wherein said bottom wall includes said rigid support plate.

5. A headrest in accordance with claim 1, wherein said outer material covering is made of covering materials selected from the group consisting vinyls, leathers, cottons, cotton-blends, nylons, rayons, polyesters, neoprenes and combinations thereof.

6. A headrest in accordance with claim 1, wherein said foam support cushion is made from foam materials such as urethanes, aerated rubber products and cotton pads.

7. A headrest in accordance with claim 1, wherein said rigid support plate is made of durable materials selected from the group consisting of plastics; light-weight metals such as aluminum; and wood products such as plywood, luan board, or composite particle-board.

8. A headrest in accordance with claim 1, wherein said support connecting members are made from durable tubular materials such as plastic or metal.

9. A headrest in accordance with claim 1, wherein said base support member is made of durable materials selected from the group consisting of plastics, light-weight metals, plastic coated metals, plasticized rubber and wood products.

10. A headrest in accordance with claim 2, wherein said carrying strap is made of fabric materials, leathers, or flexible plastics.

11. A headrest in accordance with claim 1, wherein said support connecting member has a height measurement of at least ⅞ of an inch.

12. A headrest in accordance with claim 1, wherein said head support member has a width measurement of 11½ inches, a length measurement of 11½ inches, and a thickness measurement of 2¼ inches.

13. A headrest in accordance with claim 3, wherein said top and bottom walls of said head support member have a width measurement of 4⅜ inches.

14. A headrest in accordance with claim 3, wherein said open space of said head support member has a width measurement of 2¾ inches.

15. A headrest in accordance with claim 1, wherein said rigid base support member has a width measurement of 10 inches, a length measurement of 10 inches, and a thickness measurement of 3/16 of an inch.

16. A headrest in accordance with claim 1, wherein said rigid base support member includes a top wall surface, a bottom wall surface, an inner perimeter edge, an outer perimeter edge, a first end and a second end having an open space therebetween.

17. A headrest in accordance with claim 16, wherein said top and bottom wall surfaces have a width measurement of 2½ inches.

18. A headrest in accordance with claim 16, wherein said open space has a width measurement of 5 inches.

19. A portable headrest for sunbathing, comprising:

a) a head support member having a bottom wall having a generally U-shaped configuration;

b) said head support member being inflatable and having a rigid support plate on said bottom wall thereof;

c) a rigid base support member having a flat generally U-shaped configuration for providing a stable support on sand, soft ground, or grass without sinking therein; said rigid base support member having an outer perimeter edge and an inner perimeter edge with an open space therebetween;

d) a plurality of spaced-apart support connecting members for connecting said head support member to said base support member;

e) said plurality of spaced-apart support connecting members defining a plurality of air passageways between the bottom of said head support member and the top of said base support member for allowing the passage of air therethrough to the user's face when the face is embedded downwardly in said head support member; and f) said headrest having a weight measurement in the range of 1½ pounds to 2 pounds for ease of portability by the user.

20. A portable headrest for sunbathing, comprising:

a) a head support member having a generally curved-shaped configuration and a recess for receiving the user's face;

b) said head support member including an outer material covering, an internal foam support cushion and a rigid support plate on the bottom thereof;

c) a rigid base support member having a flat generally curved-shaped configuration for providing a stable support on sand, soft ground, or grass without sinking therein; said rigid base support member having an outer perimeter edge and an inner perimeter edge with an open space therebetween;

d) a plurality of spaced-apart support connecting members for connecting said head support member to said base support member;

e) said plurality of spaced-apart support connecting members defining a plurality of air passageways between the bottom of said head support member and the top of said base support member for allowing the passage of air therethrough to the user's face when the face is embedded downwardly in said head support member; and f) said headrest having a weight measurement in the range of 1½ pounds to 2 pounds for ease of portability by the user.

* * * * *